United States Patent [19]

Guthrie

[11] Patent Number: 4,688,700

[45] Date of Patent: Aug. 25, 1987

[54] DISPENSER FOR COLLAPSIBLE TUBES

[76] Inventor: Richard A. Guthrie, 17249 N. 7th St., #1201, Phoenix, Ariz. 85022

[21] Appl. No.: 842,293

[22] Filed: Mar. 21, 1986

[51] Int. Cl.[4] ..... B65D 35/22

[52] U.S. Cl. ..... 222/94; 222/100; 222/205

[58] Field of Search ..... 222/94, 99, 100, 105, 222/135, 205, 571; 248/108, 109; 206/1.7, 1.8

[56] References Cited

U.S. PATENT DOCUMENTS

| | | | |
|---|---|---|---|
| 1,074,463 | 9/1913 | Riordox | 222/100 |
| 1,192,818 | 8/1916 | Covington | 222/100 |
| 1,680,994 | 8/1928 | Karpe | 222/100 |
| 2,069,048 | 1/1937 | Rehberger | 222/205 |
| 2,111,181 | 3/1938 | Findley | 222/100 |
| 2,166,616 | 7/1939 | Wallace | 206/1.7 |
| 2,530,476 | 11/1930 | Morris | 222/100 |
| 2,756,530 | 7/1956 | Nelson | 222/94 |
| 3,131,833 | 5/1964 | Campbell et al. | 222/205 |
| 3,139,208 | 6/1964 | Irwin et al. | 206/1.8 |

FOREIGN PATENT DOCUMENTS

| | | | |
|---|---|---|---|
| 71428 | 3/1916 | Austria | 248/108 |
| 597860 | 5/1934 | Fed. Rep. of Germany | 222/105 |
| 614684 | 12/1926 | France | 222/100 |
| 101898 | 4/1941 | Sweden | 222/100 |
| 820200 | 9/1959 | United Kingdom | 222/100 |

*Primary Examiner*—H. Grant Skaggs
*Attorney, Agent, or Firm*—D. W. Erickson

[57] ABSTRACT

A dispenser for storing and dispensing semi-liquid or paste substances contained in a flexible or collapsible tube which comprises a housing having a top wall and at least two side supporting walls, a tube adapter releasably mounted in the top wall of the housing, said adapter having a reservoir in communication with said tube and a cap, and a roller key for engaging the bottom of said tube and dispensing the contents of the tube into said reservoir as the key is turned, said key being mounted in two opposing slots in said side walls.

4 Claims, 9 Drawing Figures

DISPENSER FOR COLLAPSIBLE TUBES

BACKGROUND OF THE INVENTION

Dispensers for dispensing semi-liquid or viscous substances commonly packaged in a flexible or collapsible tube described in the prior art have various disadvantages. Some prior art dispensers lack versatility in that the dispenser must be wall mounted for use. Other dispensers have the disadvantage of lacking means for effectively dispensing the contents of the collapsible tube. Typical dispensers are described in U.S. Pat. Nos. 3,131,833, 2,756,530, 2,600,553, 2,570,077, and 1,638,613.

SUMMARY OF THE INVENTION

The present invention is directed at an inexpensive and convenient to use dispenser for holding one or more collapsible tubes and dispensing the tube contents into a reservoir mounted in the top wall of the dispenser. The dispenser of the present invention is very versatile as will be demonstrated hereinafter. It can be used to hold and dispense substances packaged in a collapsible tube such as toothpaste, cosmetics, greasepaint, lotions, creams, shoe polish, artist's paints, and the like. The dispenser of the present invention comprises: a housing; a tube adapter having a reservoir and a cap, said adapter being releasable mounted in the top wall of the housing; and a roller key slidably mounted in opposing slots in the side walls of the housing for applying uniform pressure to the collapsible tube, said tube being threaded into the base of the tube adapter. The base of the tube adapter is provided with an orifice which permits passage of the tube contents from the tube into the tube adapter reservoir whenever the roller key is turned and thereby applying pressure on the collapsible tube.

DETAILED DESCRIPTION OF THE INVENTION

Figure 1:
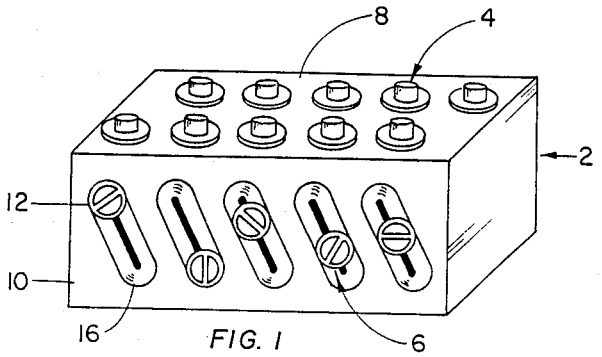
FIG. 1 is a perspective view of a dispenser in accordance with the present invention.
Figure 4:
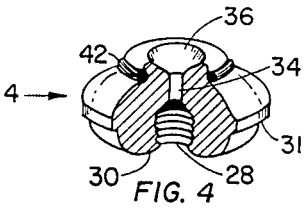
FIG. 4 is an enlarged partial cross-section of the tube adapter of the dispenser of FIG. 1.
Figure 2:
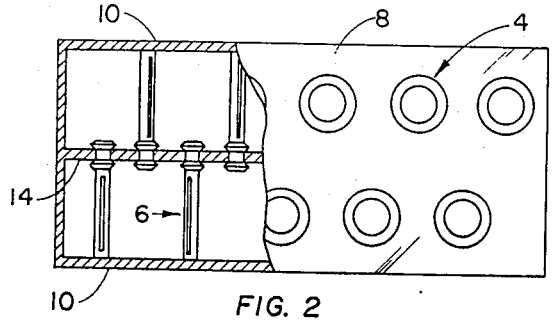
FIG. 2 is a top view, with partial breakaway of the top wall, of the dispenser of FIG. 1.
Figure 5:
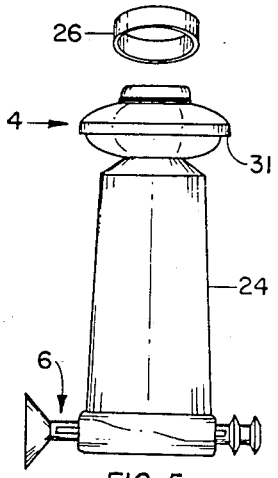
FIG. 5 is a perspective view of the tube adapter and roller key, each connected to a collapsible tube of the artist's paint as used in the dispenser of FIG. 1.
Figure 3:
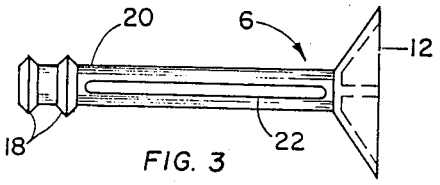
FIG. 3 is an enlarged view of the roller key of the dispenser of FIG. 1.
Figure 7:
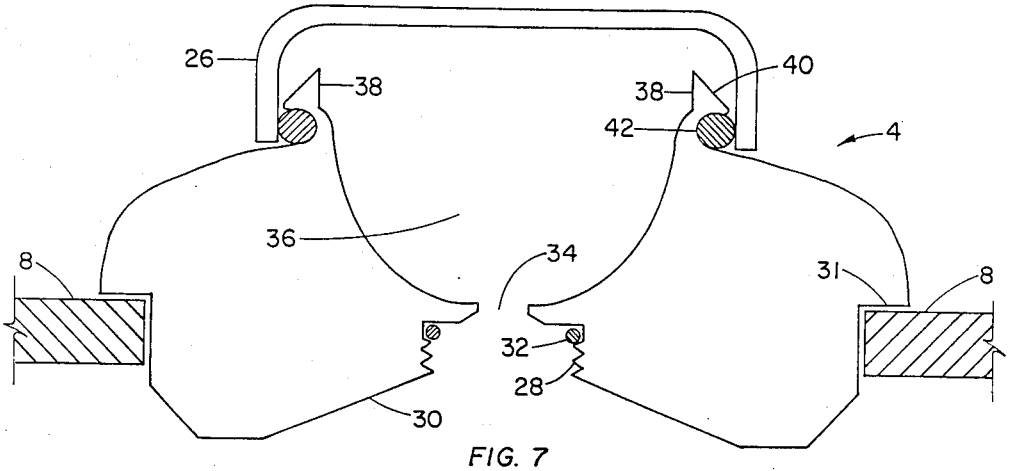
FIG. 7 is an enlarged cross-section of the tube adapter used in the dispenser of FIG. 1.

Referring to FIG. 1 of the drawings, there is shown a dispenser of the present invention comprising a housing 2, tube adapter 4 and roller key 6. The housing has a top wall 8 in which the tube adapter is releasably mounted and supporting side walls 10 which have a slot for receiving and guiding the key roller 6. As shown in FIG. 1, the slot may be recessed so that the wall is smooth and the control knob 12 does not project out from the wall. The dispenser of FIG. 1 is very useful for holding, organizing and dispensing artist's paints. Provided with a double row, a multitude of collapsible tubes of paint can be conveniently stored; but yet, ready for immediate use. In order to have a double row, referring to FIG. 2, an inner wall 14 is provided which has ten slots, each cooperatively opposed to the five slots 16 in each of the side walls 10. By staggering the tube adapters in the top wall and slots in the side walls, as shown in FIGS. 1 and 2, true alignment of the key roller is maintained and the holding and storing capacity of the dispenser is increased. Referring to FIG. 3 an enlarged view of the key roller 6 used in the dispenser of FIG. 1 is shown. The key roller has a control knob 12, at one end of the shaft 20, which is beveled in order to seat in the recessed slot 16. The other end of the roller key has two alignment disks 18 which provide a secure and positive seating of the key roller in the slot of the inner wall 14. The shaft 20 is provided with a relatively narrow slot 22 adapted to receive the bottom end of a collapsible tube 24 as shown in FIG. 5. Referring to FIGS. 4, 5, and 7, detail of the tube adapter is shown. The tube adapter, which includes the cap 26, has a threaded opening 28 at its base 30 which is designed to cooperatively and securely receive the threaded end of the collapsible tube 24 as shown in FIG. 5. The base 30 is cambered leading into the threaded opening 28 which is provided with an internal O-ring seal 32 in order to insure positive engagement of the tube adapter and collapsible tube. An orifice 34 is provided at the top of the threaded opening 28 to permit passage of the collapsible tube contents into the reservoir 36 when the roller key is turned. The orifice 34, as shown in FIGS. 4 and 7, is constricted as compared to the threaded opening 28. The advantages of the constricted orifice leading into the reservoir 36 include better control of the flow of the tube contents and much improved storage life or preservation of the contents of the collapsible tube. The tube adapter is further characterized by having a vertical wiping lip 38 at the top edge of the bowl shaped reservoir 36 as shown in FIG. 7. The wiping lip 38 has a beveled edge or rim 40 and external O-ring seal 42 which provide for a good positive seating of the cap 26, thereby preserving any substance in the reservoir 36 and also increasing the storage life of the contents of the collapsible tube 24. A shoulder 31 is provided for seating the adapter on top wall 8.

Figure 6:
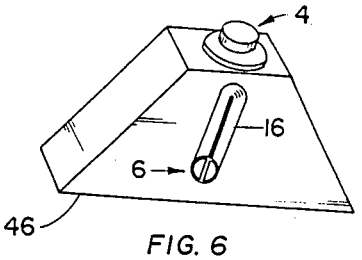
FIG. 6 is a perspective view of another embodiment of a dispenser of the present invention.

Referring to FIG. 6, in another embodiment of the present invention, a dispenser is provided for holding and dispensing the contents of a single collapsible tube. In this embodiment a broad base 46 is provided which imparts stability to the dispenser and facilitates use of dispenser on a counter or table surface for dispensing such substances as toothpaste, cosmetics, lotions, creams and the like.

Figure 8:
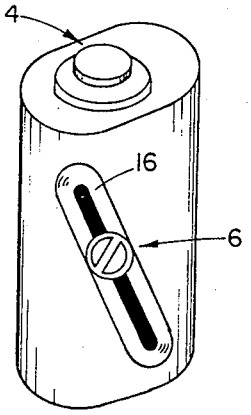
FIGS. 8 and 9 are perspective views of additional embodiments of a dispenser in accordance with the present invention.
Figure 9:
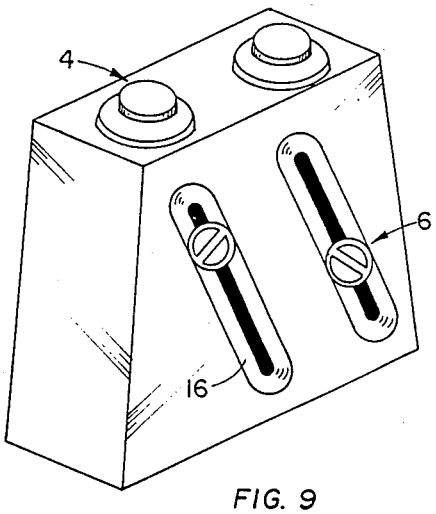

Additional embodiments of the dispenser of the present invention are shown in FIGS. 8 and 9 wherein a single tube and a double tube dispenser, respectively, are illustrated. FIG. 8 illustrates that the housing need not be limited to square or rectangular configuration; but rather, may be elliptical or circular so long as two two opposing slots for receiving and guiding the key roller can be provided in the housing wall.

The dispenser is preferably constructed of a rigid plastic which may be either transparent, opaque or a combination thereof. Suitable plastics include rigid polyethylene, polypropylene, polyvinyl chloride, polystyrene and copolymers thereof.

The dispenser can be manufactured using known molding technology. In one method of manufacture the key roller(s) is (are) in place in the mold prior to molding the housing. In another method of manufacture, the housing is first molded and then the key roller is inserted. In this method the key roller is a two piece unit, the control knob 12 being threadedly engaged to the shaft 20.

In the preferred embodiment, the dispenser housing does not have a bottom wall. If it is desired to have a bottom wall in the housing, then it is preferable that the bottom wall be removeable. Alternatively, whether a bottom wall is present or not, the top wall 8 can be removeably attached, as for example, by friction engagement, to the side walls 10.

The slots 16 in which the key roller 6 is mounted provide a guideway or raceway for the roller key in order to insure uniform pressure on the collapsible tube 24 when the roller key is turned. The slots can be disposed vertically true as in FIG. 6 or on a slight diagonal as in FIG. 1. In the preferred embodiment, the slots 16 in the side walls are recessed or concave shaped as shown in the drawings in order to accomodate the beveled control knob 12. Alternatively, the slots may not be recessed but rather, straight and flush with the surface of the side wall. In such case, the control knob will project out from the surface of the side wall. The length of the slot will be governed by the size of the collapsible tube to be used. In lieu of the elliptically shaped slot 16 shown in the drawings, there can be used a U-shaped slot with the open end of the slot terminating at either the top edge or the bottom edge of the side wall 10 or the inner wall 14.

In the preferred embodiment, the control knob 12 of the key roller is beveled as shown in the drawings.

Alternatively, the control knob can have other shapes such as spherical, oblong, key shape, and the like.

What is claimed is:

1. A dispenser for storing a plurality of collapsible tubes and dispensing the contents of each tube which comprises:

a housing having a top wall, at least two supporting side walls, and a base defined by the bottom end of said side walls, and an inner wall parallel to the side walls;

tube adapters releasably mounted in the top wall in two rows separated by the inner wall, the base of each adapter having a threaded opening to accept the threaded end of said tube, said threaded opening leading to an orifice in the bottom of a bowl-shaped reservoir of the adapter, said adapter being provided with a removeable cap to cover said reservoir;

a roller key for engaging the bottom end of each tube and dispensing the contents of the tube into said reservoir as the key is turned, said key being mounted in two opposing slots in the inner wall and each side wall which cooperatively receive said key roller, said slots being generally vertically disposed relative to the base of the housing; and said tube adapters and slots being uniformly staggered in arrangement.

2. The dispenser according to claim 1 wherein the orifice is constricted, the diameter of said orifice being from about one-fourth to one-half as large as the diameter of the threaded opening of the tube adapter.

3. The dispenser according to claim 1 wherein said slots are slightly diagonally disposed relative to the base of the housing.

4. The dispenser according to claim 1 wherein said tube adapter has a vertical wiping lip at the top edge of the bowl-shaped reservoir.

* * * * *